US010170096B1

(12) United States Patent
Valeri et al.

(10) Patent No.: US 10,170,096 B1
(45) Date of Patent: Jan. 1, 2019

(54) AUDIO CONTROL SYSTEMS AND METHODS FOR MITIGATING STRUCTURAL NOISE BORNE FROM TIRES

(71) Applicant: GM GLOBAL TECHNOLOGY OPERATIONS LLC, Detroit, MI (US)

(72) Inventors: Frank C. Valeri, Novi, MI (US); Christopher A. Stirlen, Milford, MI (US); Scott M. Reilly, Southfield, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 15/800,524

(22) Filed: Nov. 1, 2017

(51) Int. Cl.
*G10K 11/178* (2006.01)

(52) U.S. Cl.
CPC ..... *G10K 11/1786* (2013.01); *G10K 11/178* (2013.01); *G10K 2210/1282* (2013.01); *G10K 2210/3046* (2013.01)

(58) Field of Classification Search
CPC ..... G10K 11/1786; G10K 11/178; G10K 11/1788; G10K 2210/1282; G10K 2210/3046
USPC ..... 381/71.1, 71.4
See application file for complete search history.

(56) References Cited

U.S. PATENT DOCUMENTS

2011/0142248 A1* 6/2011 Sakamoto ..... G10K 11/178 381/71.4
2012/0189132 A1* 7/2012 Sakamoto ..... G10K 11/178 381/71.4
2012/0257763 A1* 10/2012 Bowden ..... G10K 11/178 381/71.4
2013/0132670 A1* 5/2013 Nishikawa ..... G11C 11/5628 711/114
2013/0136270 A1* 5/2013 Sakamoto ..... G10K 11/16 381/71.4
2013/0259249 A1* 10/2013 Sakamoto ..... G10K 11/175 381/71.4
2016/0157041 A1* 6/2016 Shiozawa ..... H04S 7/302 381/302
2017/0330551 A1* 11/2017 Zafeiropoulos .... G10K 11/1788

* cited by examiner

*Primary Examiner* — Disler Paul

(57) ABSTRACT

A Fourier Transform (FT) module configured to determine amplitudes of acceleration at predetermined orders, respectively, by performing a FT on a plurality of values of acceleration associated with a wheel. An order module is configured to identify one of the predetermined orders where one of the amplitudes is greater than a predetermined value and to, based on the one of the amplitudes and a rotational speed of the wheel, determine an order of a frequency corresponding to the rotational speed of the wheel. A sound control module is configured to set characteristics for outputting sound at the order of the frequency corresponding to the rotational speed of the wheel. An audio driver module is configured to, based on the characteristics, apply power to a speaker within a passenger cabin of the vehicle at the order of the frequency corresponding to the rotational speed of the wheel.

20 Claims, 3 Drawing Sheets

AUDIO CONTROL SYSTEMS AND METHODS FOR MITIGATING STRUCTURAL NOISE BORNE FROM TIRES

INTRODUCTION

The information provided in this section is for the purpose of generally presenting the context of the disclosure. Work of the presently named inventors, to the extent it is described in this section, as well as aspects of the description that may not otherwise qualify as prior art at the time of filing, are neither expressly nor impliedly admitted as prior art against the present disclosure.

The present disclosure relates to vehicle audio systems and more particularly to systems and methods for producing sound within a passenger cabin to attenuate tire noise.

Some vehicles include conventional powertrains having an internal combustion engine and a drivetrain that normally emit sounds during vehicle operation. Many consumers have come to rely on these normal sounds as a sign of proper vehicle function. Changes in these normal sounds may indicate, to certain consumers, that the internal combustion engine and/or the drivetrain may be functioning differently than expected.

Some consumers may have expectations as to what the normal sounds of different types of vehicle should be. For example, a consumer may expect certain sounds from "high performance" vehicles, while some sounds may not be expected from other types of vehicles. An absence of expected sounds may detract from a user's enjoyment of a vehicle. Presence of unexpected vehicle sounds may also detract from a user's enjoyment of a vehicle.

SUMMARY

In a feature, an audio control system for mitigating structural noise from tires of a vehicle is described. A Fourier Transform (FT) module is configured to determine amplitudes of acceleration at predetermined orders, respectively, by performing a FT on a plurality of values of acceleration associated with a first wheel of the vehicle. An order module is configured to identify one of the predetermined orders where one of the amplitudes is greater than a predetermined value and to, based on the one of the amplitudes and a first rotational speed of the first wheel, determine a first order of a first frequency corresponding to the first rotational speed of the first wheel of the vehicle. A sound control module is configured to set characteristics for outputting sound at the first order of the first frequency corresponding to the first rotational speed of the first wheel. An audio driver module is configured to, based on the characteristics, apply power to a first speaker within a passenger cabin of the vehicle at the first order of the first frequency corresponding to the first rotational speed of the first wheel.

In further features, the order module is configured to determine the first order of the first frequency corresponding to the first rotational speed of the first wheel based on the one of the amplitudes divided by the first rotational speed of the first wheel.

In further features: the order module is further configured to determine a second order of a second frequency corresponding to a second rotational speed of a second wheel based on the one of the amplitudes and the second rotational speed of the second wheel; the sound control module is further configured to set the characteristics for outputting sound at the second order of the second frequency corresponding to the second rotational speed of a second wheel; and the audio driver module is further configured to, based on the characteristics, apply power to a second speaker within the passenger cabin of the vehicle at the second order of the second frequency.

In further features: the order module is further configured to determine a third order of a third frequency corresponding to a third rotational speed of a third wheel based on the one of the amplitudes and the third rotational speed of the third wheel; the sound control module is further configured to set the characteristics for outputting sound at the third order of the third frequency corresponding to the third rotational speed of the third wheel; and the audio driver module is further configured to, based on the characteristics, apply power to a third speaker within the passenger cabin of the vehicle at the third order of the third frequency.

In further features: the order module is further configured to determine a fourth order of a fourth frequency corresponding to a fourth rotational speed of a fourth wheel based on the one of the amplitudes and the fourth rotational speed of the fourth wheel; the sound control module is further configured to set the characteristics for outputting sound at the fourth order of the fourth frequency corresponding to the fourth rotational speed of the fourth wheel; and the audio driver module is further configured to, based on the characteristics, apply power to a fourth speaker of the vehicle at the fourth order of the fourth frequency.

In further features, an enabling/disabling module is configured to disable the FT module and the order module when at least one of: the first rotational speed of the first wheel is less than a first predetermined speed; and the first rotational speed of the first wheel is greater than a second predetermined speed, wherein the second predetermined speed is greater than the first predetermined speed.

In further features, the first predetermined speed is greater than zero.

In further features, an enabling/disabling module is configured to disable the FT module and the order module when at least one of: the first rotational speed of the first wheel is less than a first predetermined speed; the first rotational speed of the first wheel is greater than a second predetermined speed, where the second predetermined speed is greater than the first predetermined speed; a second rotational speed of a second wheel is less than the first predetermined speed; the second rotational speed of the second wheel is greater than the second predetermined speed; a third rotational speed of a third wheel is less than the first predetermined speed; the third rotational speed of the third wheel is greater than the second predetermined speed; a fourth rotational speed of a fourth wheel is less than the first predetermined speed; and the fourth rotational speed of the fourth wheel is greater than the second predetermined speed.

In further features, the enabling/disabling module is configured to enable the FT module and the order module when all of: the first rotational speed of the first wheel is greater than the first predetermined speed and less than the second predetermined speed; the second rotational speed of the second wheel is greater than the first predetermined speed and less than the second predetermined speed; the third rotational speed of the third wheel is greater than the first predetermined speed and less than the second predetermined speed; and the fourth rotational speed of the fourth wheel is greater than the first predetermined speed and less than the second predetermined speed.

In further features: the first speaker is located on one of a left side of the vehicle and a right side of the vehicle; and the first wheel is located on the other one of the left side of the vehicle and the right side of the vehicle.

In further features, the first speaker is associated with the first wheel of the vehicle.

In further features, the acceleration is measured using an acceleration sensor associated with the first wheel of the vehicle.

In further features, the FT is one of a Fast Fourier Transform (FFT) and a Discrete Fourier Transform (DFT).

In further features, a first wheel speed sensor is configured to measure the first rotational speed of the first wheel.

In further features, an acceleration sensor is associated with the first wheel and is configured to measure the plurality of values of the acceleration associated with the first wheel.

In further features, the sound control module is configured to set a magnitude for outputting sound at the first order of the first frequency corresponding to the first rotational speed of the first wheel based on the one of the amplitudes, and the audio driver module is configured to, at the first order of the first frequency corresponding to the first rotational speed of the first wheel, apply power to the first speaker based on the magnitude.

In further features, the sound control module configured to set a magnitude for outputting sound at the first orders of the first frequency corresponding to the first rotational speed of the first wheel based on sound within the passenger cabin received by a microphone within the passenger cabin of the vehicle, and the audio driver module is configured to, at the first order of the first frequency corresponding to the first rotational speed of the first wheel, apply power to the first speaker based on the magnitude.

In further features, the sound control module is configured to set a magnitude for outputting sound at the first order of the first frequency corresponding to the first rotational speed of the first wheel to a predetermined magnitude, and the audio driver module is configured to, at the first order of the first frequency corresponding to the first rotational speed of the first wheel, apply power to the first speaker based on the magnitude.

In a feature, an audio control method for mitigating structural noise from tires of a vehicle, includes: determining amplitudes of acceleration at predetermined orders, respectively, by performing a Fourier Transform (FT) on a plurality of values of acceleration associated with a first wheel of the vehicle; identifying one of the predetermined orders where one of the amplitudes is greater than a predetermined value; based on the one of the amplitudes and a first rotational speed of the first wheel, determining a first order of a first frequency corresponding to the first rotational speed of the first wheel of the vehicle; setting characteristics for outputting sound at the first order of the first frequency corresponding to the first rotational speed of the first wheel; and based on the characteristics, applying power to a first speaker within a passenger cabin of the vehicle at the first order of the first frequency corresponding to the first rotational speed of the first wheel.

In a feature, a non-transitory computer readable medium includes instructions that, when executed, perform a method for mitigating structural noise from tires of a vehicle including: determining amplitudes of acceleration at predetermined orders, respectively, by performing a Fourier Transform (FT) on a plurality of values of acceleration associated with a first wheel of the vehicle; identifying one of the predetermined orders where one of the amplitudes is greater than a predetermined value; based on the one of the amplitudes and a first rotational speed of the first wheel, determining a first order of a first frequency corresponding to the first rotational speed of the first wheel of the vehicle; setting characteristics for outputting sound at the first order of the first frequency corresponding to the first rotational speed of the first wheel; and based on the characteristics, applying power to a first speaker within a passenger cabin of the vehicle at the first order of the first frequency corresponding to the first rotational speed of the first wheel.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings.

In the drawings, reference numbers may be reused to identify similar and/or identical elements.

DETAILED DESCRIPTION

Some vehicle tires may be round, while other vehicle tires may be egg (or oval) shaped, clover shaped, or shaped differently than round. Even within the same type and brand of vehicle tire, vehicle tires may vary from tire to tire due to minor differences in construction.

Differences in shape and construction of vehicle tires create a potential for the tires of a vehicle to collectively produce unexpected noise within a passenger cabin of the vehicle. According to the present disclosure, an audio control module generates sound within the passenger cabin of the vehicle via one or more speakers to cancel or mitigate sound produced by the tires of the vehicle. This provides a more pleasurable aural experience within the passenger cabin of the vehicle.

Figure 1:
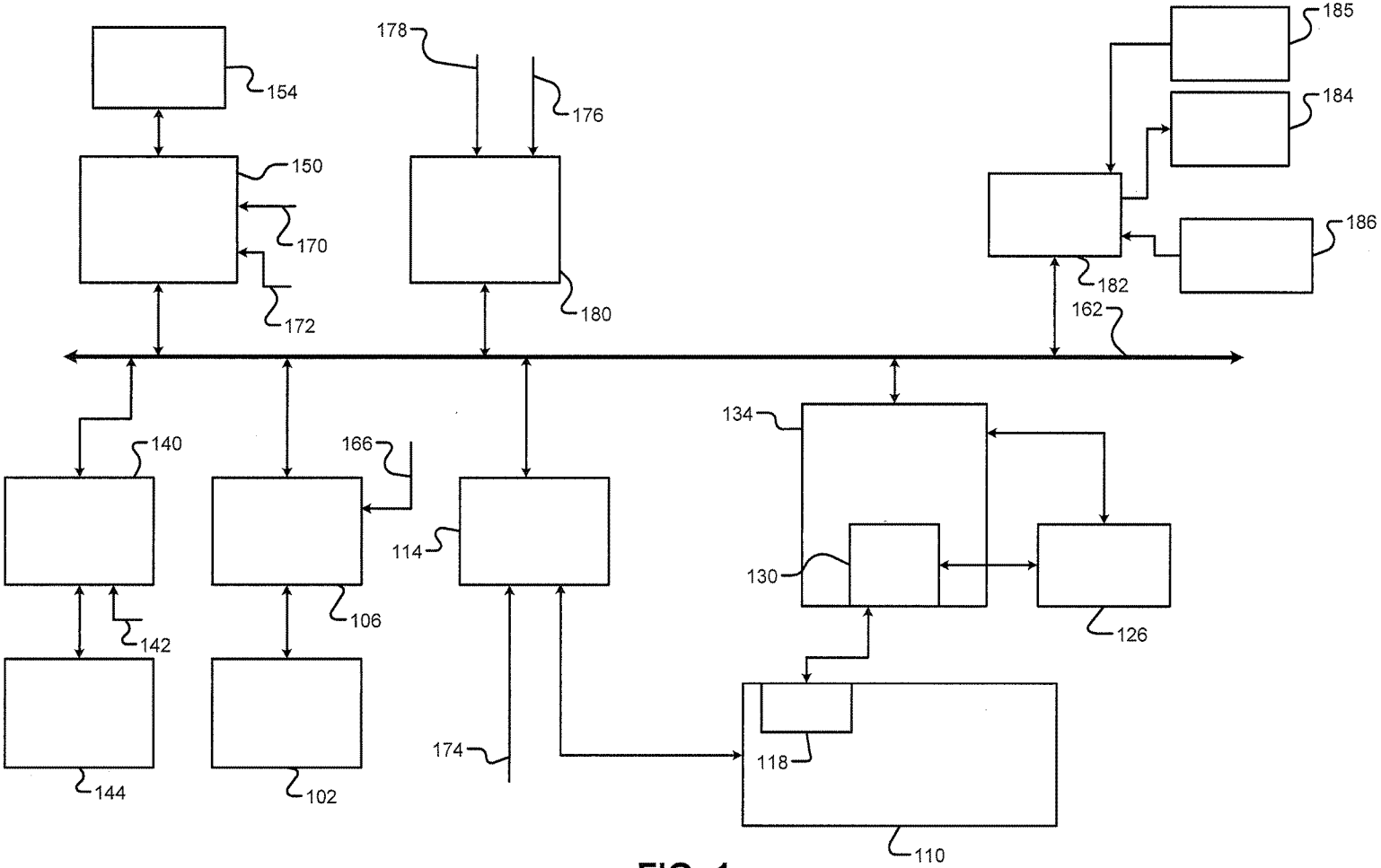
FIG. 1 is a functional block diagram including an example vehicle system.

Referring now to FIG. 1, a functional block diagram of an example vehicle system is presented. While a vehicle system for a hybrid vehicle is shown and will be described, the present disclosure is also applicable to non-hybrid vehicles, electric vehicles, fuel cell vehicles, and other types of vehicles. The present disclosure is also applicable to non-autonomous vehicles, semi-autonomous vehicles, and fully autonomous vehicles.

An engine 102 combusts an air/fuel mixture to generate drive torque. An engine control module (ECM) 106 controls the engine 102 based on a torque request. In various implementations, the ECM 106 may determine the torque request based on one or more driver inputs. For example, the ECM 106 may control actuation of engine actuators, such as a throttle valve, one or more spark plugs, one or more fuel injectors, valve actuators, camshaft phasers, an exhaust gas recirculation (EGR) valve, one or more boost devices, and other suitable engine actuators.

The engine 102 may output torque to a transmission 110. A transmission control module (TCM) 114 controls operation of the transmission 110. For example, the TCM 114 may control gear selection within the transmission 110 and one or more torque transfer devices (e.g., a torque converter, one or more clutches, etc.).

The vehicle system may include one or more electric motors. For example, an electric motor 118 may be implemented within the transmission 110 as shown in the example of FIG. 1. An electric motor can act as either a generator or as a motor at a given time. When acting as a generator, an electric motor converts mechanical energy into electrical energy. The electrical energy can be, for example, used to charge a battery 126 via a power control device (PCD) 130, such as an inverter. When acting as a motor, an electric motor generates torque that may be used, for example, to supplement or replace torque output by the engine 102. While the example of one electric motor is provided, the vehicle may include zero or more than one electric motor.

A power inverter control module (PIM) 134 may control the electric motor 118 and the PCD 130. The PCD 130 applies (e.g., direct current) power from the battery 126 to the (e.g., alternating current) electric motor 118 based on signals from the PIM 134, and the PCD 130 provides power output by the electric motor 118, for example, to the battery 126. The PIM 134 may be referred to as a power inverter module (PIM) in various implementations.

A steering control module 140 controls steering/turning of wheels of the vehicle, for example, based on driver turning of a steering wheel within the vehicle and/or steering commands from one or more vehicle control modules. A steering wheel angle sensor (SWA) monitors rotational position of the steering wheel and generates a SWA 142 based on the position of the steering wheel. As an example, the steering control module 140 may control vehicle steering via an EPS motor 144 based on the SWA 142. In various implementations, the vehicle may include another type of steering system. An electronic brake control module (EBCM) 150 may selectively control mechanical brakes 154 of the vehicle.

Modules of the vehicle may share parameters via a network 162, such as a controller area network (CAN). In vehicles, a CAN may also be referred to as a car area network. For example, the network 162 may include one or more data buses. Various parameters may be made available by a given control module to other control modules via the network 162.

The driver inputs may include, for example, an accelerator pedal position (APP) 166 which may be provided to the ECM 106. A brake pedal position (BPP) 170 may be provided to the EBCM 150. The ECM 106 may determine the torque request and control actuation of the engine actuators based on the APP 166, the BPP 170, and/or one or more other parameters.

Wheel speeds 172 may also be input to the EBCM 150. The wheel speeds 172 may be measured using wheel speed sensors, respectively. One wheel speed sensor is associated with each wheel of the vehicle. A wheel speed sensor may determine a wheel speed of the associated wheel based on a position of a shaft that rotates with that wheel. The wheel speed sensor may generate pulses based on teeth of a toothed wheel that rotates with the wheel passing the wheel speed sensor. Each pulse may correspond to a predetermined amount of rotation (e.g., 360 degrees divided by the number of teeth of the toothed wheel) of the toothed wheel and, therefore, the wheel. The wheel speed sensor determines a speed of the wheel based on the change in the position over each predetermined period. Each wheel speed sensor determines its wheel speed sensor in this manner based on rotation of the associated wheel.

The TCM 114 controls gear selection within the transmission 110, for example, based on a range selector input 174 from a transmission range selector. The transmission range selector may be a park, reverse, neutral, drive lever (PRNDL) or another suitable type of transmission range selector. The range selector input 174 may be provided to the TCM 114.

The vehicle may include accelerometers, three (or tri) axis accelerometer, that generate accelerations 176 at their respective locations. For example, the vehicle may include one accelerometer attached near (and associated with) each tire. For example, the accelerometers may be attached near suspension load points of the vehicle. Each accelerometer measures at least vertical acceleration at its location (e.g., tire) and generates the acceleration signal accordingly. Each accelerometer may also measure lateral, longitudinal, horizontal, and/or one or more other accelerations at its location (e.g., tire) and generate the acceleration signal accordingly.

An ignition state 178 may be provided to a body control module (BCM) 180. For example, the ignition state 178 may be generated based on input by a driver via an ignition key, button, or switch. At a given time, the ignition state 178 may be one of off, accessory, run, and crank. When the ignition state 178 transitions from off or accessory to crank, the BCM 180 generally closes a starter switch (e.g., relay). Closing the starter switch engages a starter with the engine 102 and drives rotation of the starter. When the starter is engaged with the engine 102, rotation of the starter drives rotation of the engine 102 for starting of the engine 102.

The vehicle system also includes an audio control module 182. The audio control module 182 controls sound output by one or more speakers 184 located within and outputting sound to a passenger cabin (or compartment) of the vehicle. The audio control module 182 may control sound output by the speakers 184 based on signals indicative of user input from one or more other user input devices 185, such as one or more switches, buttons, knobs, touchscreen displays, etc. located within the passenger cabin of the vehicle. For example, the audio control module 182 may control a volume of sound output, tuning of one or more audio sources, and/or one or more other audio characteristics based on signals from the user input devices 185.

Additionally, the audio control module 182 outputs sound via the speakers 184 based on signals from a microphone 186 located within the passenger cabin of the vehicle. The microphone 186 may be sensitive to noise experienced within the passenger cabin. In other words, the microphone 186 may generate signals based on sound attributable to the tires of the vehicle and one or more other sounds within the passenger cabin.

The audio control module 182 may receive parameters from the ECM 114, the EBCM 150, the BCM 180, the TCM 114, and/or one or more other modules of the vehicle. The audio control module 182 may receive parameters from other modules, for example, via the network 162.

Figure 2:
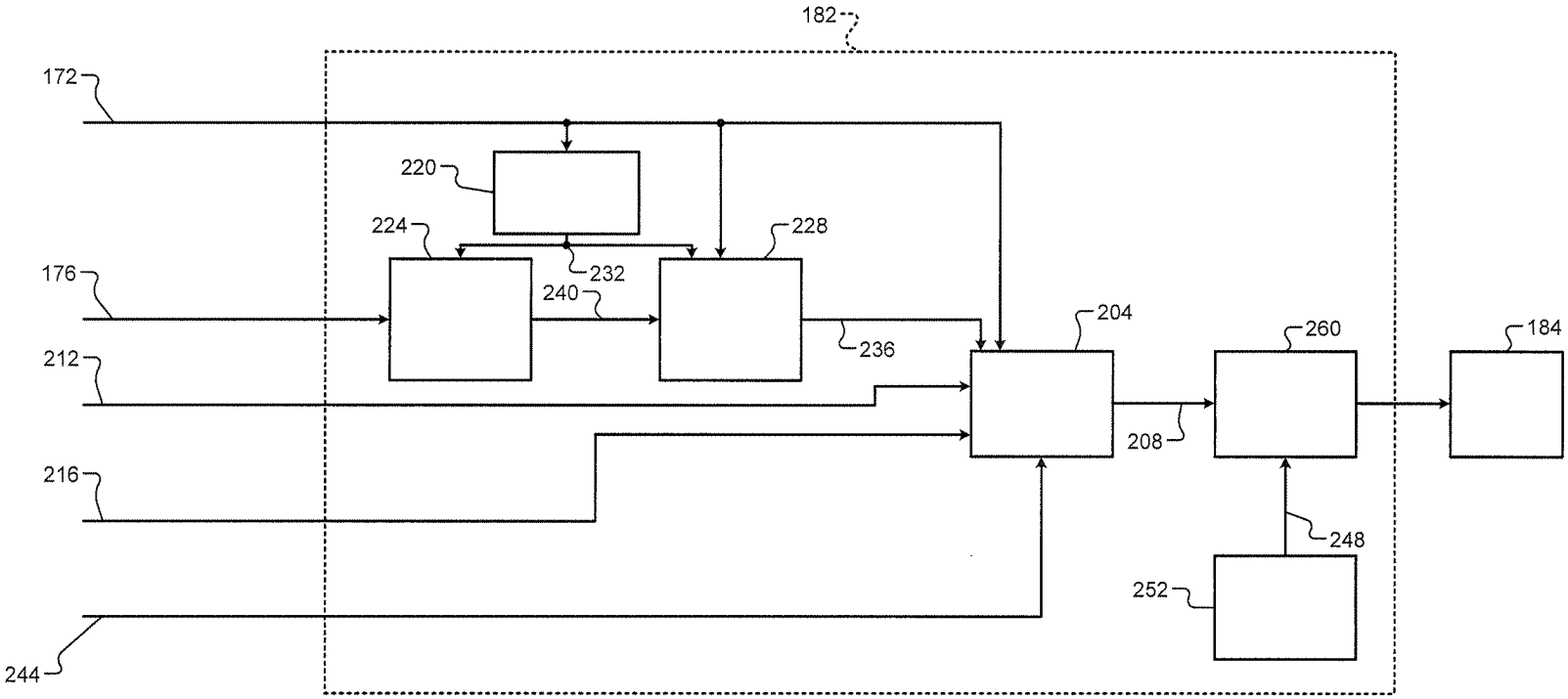
FIG. 2 is a functional block diagram including an example audio control module and speakers.

FIG. 2 is a functional block diagram of an example audio system including the audio control module 182 and the speakers 184. The speakers 184 output sound within the passenger cabin of the vehicle. For example, one or more of the speakers 184 may be located in a left front location and are associated with a left front tire, one or more of the speakers 184 may be located in a right front location and are associated with a right front tire, one or more of the speakers 184 may be located in a rear left location and are associated with a rear left tire, and one or more of the speakers 184 may be located in a rear right location and are associated with a rear right tire. As used herein, left, right, front, and rear are relative to a forward facing direction of the vehicle that the vehicle typically moves when the transmission 110 is in a forward drive gear.

A sound control module 204 determines how to output road sound via the speakers 184 based on cancelling noise within the passenger cabin. Noise sources include the engine 102, driveline components (e.g., including the transmission 110 and other components used to transfer torque to and from the wheels), and the tires of the vehicle. The sound control module 204 sets characteristics 208 for cancelling noise within the passenger cabin.

For example, the sound control module 204 sets the characteristics 208 based on cancelling engine noise and cancelling driveline noise. The sound control module 204 sets the characteristics 208 based on an engine speed 212 to cancel or attenuate engine noise. An engine speed sensor may measure a crankshaft position of a crankshaft of the engine 102. The engine speed sensor may generate pulses based on teeth of a toothed wheel that rotates with the crankshaft of the engine 102 passing the engine speed sensor. Each pulse may therefore correspond to a predetermined amount of rotation (e.g., 360 degrees divided by the number of teeth of the toothed wheel) of the crankshaft and the toothed wheel. The engine speed sensor (or, for example, the ECM 106) may determine the engine speed 212 based on the change in the crankshaft position over each predetermined period.

The sound control module 204 sets the characteristics 208 based on a driveline speed 216 to cancel or attenuate driveline noise. A driveline speed sensor may measure a shaft position of a shaft of the driveline (e.g., transmission input shaft, transmission output shaft, etc.). The driveline speed sensor may generate pulses based on teeth of a toothed wheel that rotates with the shaft of the driveline passing the driveline speed sensor. Each pulse may therefore correspond to a predetermined amount of rotation (e.g., 360 degrees divided by the number of teeth of the toothed wheel) of the shaft and the toothed wheel. The driveline speed sensor (or, for example, the EGM 106 or the TCM 114) may determine the driveline speed 216 based on the change in the position over each predetermined period.

As discussed further below, the sound control module 204 also sets the characteristics 208 to cancel or attenuate tire noise under some circumstances. Tire noise may occur within the passenger cabin under some circumstances and not occur within the passenger cabin under other circumstances. For example, tire noise may occur when all of the wheel speeds 172 are within a predetermined speed range. The predetermined speed range is lower bounded by a predetermined minimum speed and upper bounded by a predetermined maximum speed. The predetermined maximum speed is greater than the predetermined minimum speed. The predetermined minimum speed is greater than zero. The predetermined minimum and maximum speeds may be calibratable and may be, for example, approximately 50 and 90 miles per hour or other suitable speeds.

An enabling/disabling module 220 enables and disables a Fourier Transform (FT) module 224 and an order module 228 based on comparisons of the wheel speeds 172 measured using the wheel speed sensors and the predetermined speed range. For example, the enabling/disabling module 220 enables the FT module 224 and the order module 228 when all of the wheel speeds 172 are within the predetermined speed range (between the predetermined minimum and maximum speeds, inclusive). The enabling/disabling module 220 disables the FT module 224 and the order module 228 when one or more of the wheel speeds 172 is/are not within the predetermined speed range (i.e., less than the predetermined minimum speed or greater than the predetermined maximum speed). The enabling/disabling module 220 enables and disables the FT module 224 and the order module 228 via an enable/disable signal 232.

The sound control module 204 sets the characteristics 208 to not cancel or attenuate tire noise when the FT module 224 and the order module 228 are disabled. The sound control module 204 sets the characteristics 208 based on cancelling or attenuating tire noise when the FT module 224 and the order module 228 are enabled.

When enabled, the FT module 224 performs a Fourier transform, such as a Fast Fourier Transform (FFT) or a Discrete Fourier Transform (DFT) on predetermined sets of the accelerations 176 measured using the acceleration sensors, respectively. As discussed above, one acceleration sensor (and therefore one of the accelerations 176) is associated with each of the wheels. The FT module 224 performs an FT on the predetermined set of the accelerations 176 associated with the left front wheel, an FT on the predetermined set of the accelerations 176 associated with the right front wheel, an FT on the predetermined set of the accelerations 176 associated with the left rear wheel, and an FT on the predetermined set of the accelerations 176 associated with the right rear wheel. The predetermined set of one of the accelerations 176 corresponds to the values of that one of the accelerations 176 measured over a predetermined period of time.

The frequency that corresponds to a rotational speed (in revolutions per minute) and multiples of the frequency are referred to as orders. For example, the frequency that corresponds to the wheel speed of the left front wheel is referred to as the first order of the frequency of the left front wheel, two times the frequency is referred to as the second order of the frequency of the left front wheel, three times the frequency is referred to as the third order of the frequency of the left front wheel, and so on. The same is true for each of the wheels. Each wheel, however, may travel at a slightly different speed, such as due to turning, difference in tire size, road crowning/conditions, etc.

The FT module 224 produces acceleration spectrums 240 for the wheels, respectively, as a result of the FTs. More specifically, produces a left front acceleration spectrum via the FT on the predetermined set of the accelerations 176 associated with the left front wheel, a right front acceleration spectrum via the FT on the predetermined set of the accelerations 176 associated with the right front wheel, a left rear acceleration spectrum via the FT on the predetermined set of the accelerations 176 associated with the left rear wheel, and a right rear acceleration spectrum via the FT on the predetermined set of the accelerations 176 associated with the right rear wheel.

Each of the acceleration spectrums 240 includes (e.g., average) amplitudes (of acceleration, such as in meters per second squared) for predetermined orders of the frequency corresponding to the respective wheel speed. For example, the acceleration spectrum 240 for the left front wheel includes a first amplitude at the first order of the frequency of the left front wheel, a second amplitude at the second order of the frequency of the left front wheel, a third amplitude at the third order of the frequency of the left front wheel, and so on. The acceleration spectrums 240 for the other wheels include similar data determined based on the accelerations 176 associated with the other wheels, respectively.

While the example of whole orders is provided, the acceleration spectrums 240 may include one or more fractional orders, such as one or more half-orders. Also, while the three example orders are provided, the acceleration spectrums 240 may include amplitudes for two or more different orders, and the acceleration spectrums 240 may include amplitudes for other orders.

When enabled, the order module 228 sets wheel orders 236 at which to generate a predetermined tone to cancel or attenuate tire noise based on the acceleration spectrums 240, respectively. For example, the order module 228 may identify an order of one of the acceleration spectrums 240 having an amplitude that is greater than a predetermined value. As discussed above, the one of the acceleration spectrums 240 is associated with one of the wheels. The order module 228 may do this for each of the acceleration spectrums 240 to identify all of the orders of all of the wheels having amplitudes that are greater than the predetermined value.

Alternatively, in various implementations, the order module 228 may search the acceleration spectrums 240 collectively to identify N of the orders (out of all of the acceleration spectrums 240) having the N largest amplitudes that are greater than the predetermined value. For example, due to their amplitudes being the largest, the order module 228 may identify the second order of the frequency corresponding to the speed of the left front wheel, the third order of the frequency corresponding to the speed of the right front wheel, and the half-order of the frequency corresponding to the speed of the right rear wheel. While the example of three (i.e., N=3) is provided, N is an integer greater than zero, and other orders and/or other wheels may have the largest amplitudes.

For each order having an amplitude that is greater than the predetermined value, the order module 228 divides the amplitude (the acceleration) of that order by each of the wheel speeds. For example, when the second order of the left front tire has an amplitude that is greater than the predetermined value, the order module 228 divides the amplitude (the acceleration) of the second order of the left front wheel by (i) the wheel speed of the left front wheel, (ii) the wheel speed of the right front wheel, (iii) the wheel speed of the left rear wheel, and (iv) the wheel speed of the right rear wheel. The wheel speeds may first be converted into units corresponding to the acceleration, such as meters per second, using a predetermined diameter of the wheel and conversion from minutes (e.g., as in rpm) to seconds. The result of the division is (i) an order for the left front wheel, (ii) an order for the right front wheel, (iii) an order for the left rear wheel, and (iv) an order for the right rear wheel.

In various implementations, for each order having an amplitude that is greater than the predetermined value, the order module 228 may determine the order associated with that amplitude from that one of the acceleration spectrums 240 and divide the amplitude (the acceleration) by each of the wheel speeds of the other wheels. For example, when the second order of the left front tire has an amplitude that is greater than the predetermined value, the order module 228 may divide the amplitude (the acceleration) of the second order of the left front wheel by (ii) the wheel speed of the right front wheel, (iii) the wheel speed of the left rear wheel, and (iv) the wheel speed of the right rear wheel. Similar to the above, the wheel speeds may first be converted into units corresponding to the acceleration, such as meters per second, using the predetermined diameter of the wheel and conversion from minutes (e.g., as in rpm) to seconds. The result of the division is (ii) an order for the right front wheel, (iii) an order for the left rear wheel, and (iv) an order for the right rear wheel. In this example, the order for the left front wheel is determined from the acceleration spectrum 240 for the left front wheel.

The order module 228 divides the wheel speeds by each of the amplitudes that is greater than the predetermined value to produce a set of orders for the respective wheels at which to generate the predetermined tone to cancel or attenuate tire noise. When, out of all of the acceleration spectrums 240, none of the amplitudes is greater than the predetermined value, the sets may each include zero orders. When one or more amplitudes are greater than the predetermined value, the sets each include one or more orders for the respective wheels. The wheel orders 236 include the sets of orders for the respective wheels.

As described above, the sound control module 204 sets the characteristics 208 to cancel or attenuate tire noise when the FT module 224 and the order module 228 are enabled. The characteristics 208 include frequencies for the respectively wheels, at which to output the predetermined tone for canceling tire noise. The characteristics 208 also include magnitudes at which to output the predetermined tone at the respective frequencies to cancel or attenuate tire noise. The sound control module 204 determines the frequencies for each wheel based on that wheel's set of wheel orders and the wheel speed of that wheel.

The sound control module 204 may (e.g., initially) set the magnitudes at which to output the predetermined tone for cancelling tire noise to a predetermined magnitude. Additionally or alternatively, the sound control module 204 may determine the magnitude based on a magnitude at the frequency in a microphone signal 244 generated by the microphone 186 within the passenger cabin. The sound control module 204 may set the magnitude, for example, using one of an equation and a lookup table that relates magnitudes of the microphone signal 244 to magnitudes for outputting the predetermined tone. For example, the sound control module 204 may decrease the magnitude for a frequency when the magnitude of the microphone signal 244 at the frequency is greater than a predetermined value and may increase the magnitude when the magnitude of the microphone signal 244 is less than a predetermined value.

Additionally or alternatively, the sound control module 204 may determine the magnitude for a frequency based on the associated amplitude (that is greater than the predetermined value). The sound control module 204 may set the magnitude, for example, using one of an equation and a lookup table that relates acceleration amplitudes to magnitudes for outputting the predetermined tone. For example, the sound control module 204 may increase the magnitude as the amplitude increases and vice versa.

The sound control module 204 may also generate the characteristics 208 to output sound from the speaker(s) of the opposite side (left or right) of the vehicle. For example, based on acceleration greater than the predetermined value at the left front tire, the sound control module 204 generates the characteristics 208 to output the predetermined tone at the frequency via the one or more right front speakers. Similarly, based on acceleration greater than the predetermined value at the right rear tire, the sound control module 204 generates the characteristics 208 to output the predetermined tone at the frequency via the one or more left rear speakers. This enhances cancellation/attenuation of noise produced by the tires.

An audio driver module 260 receives the characteristics 208 and may receive predetermined tones 248 stored in memory 252. The audio driver module 260 applies power (e.g., from the one or more other batteries) to the respective speakers 184 according to the characteristics 208. More specifically, the audio driver module 269 applies power to the respective speakers 184 at the frequencies and magnitudes specified by the characteristics 208. The sound output by the speakers 184 therefore cancels or attenuates sound/noise produced by the tires within the passenger cabin of the vehicle.

Figure 3:
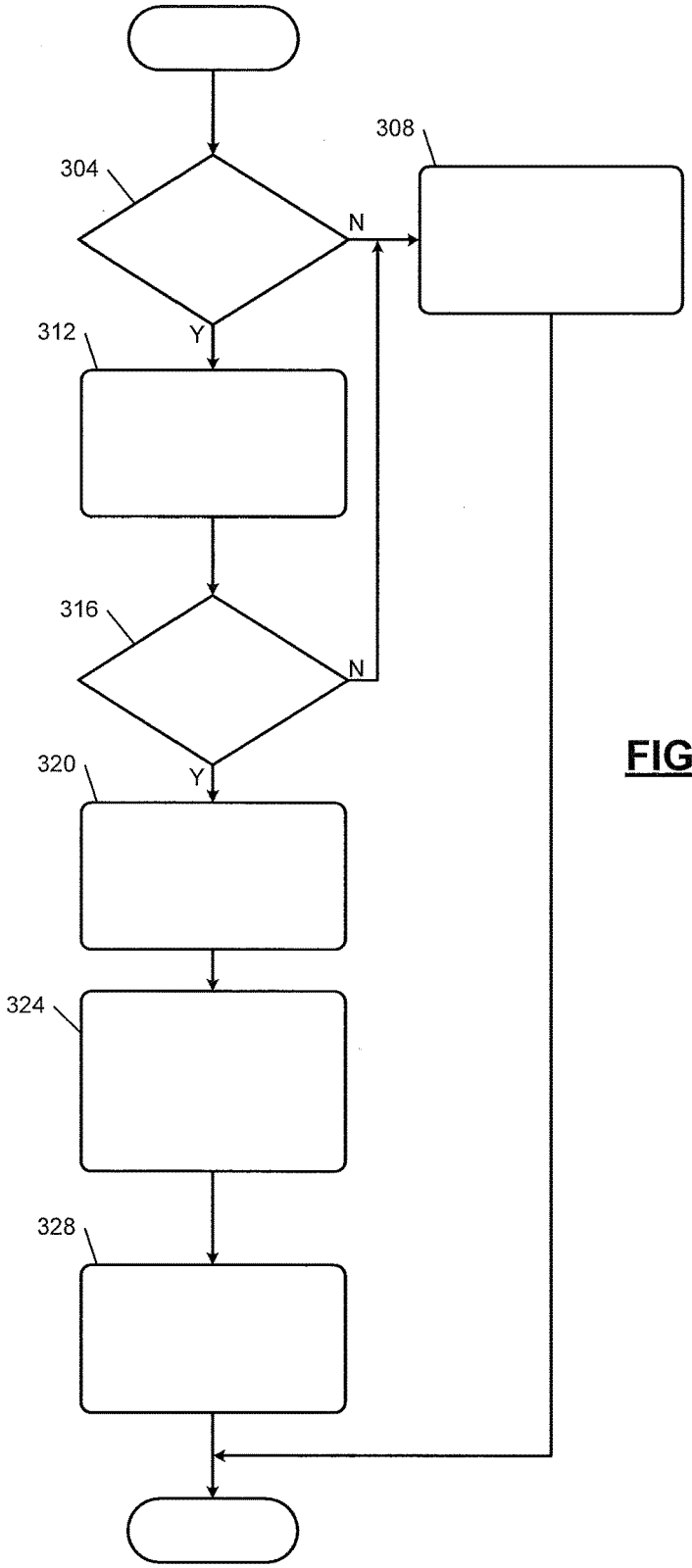
FIG. 3 is a functional block diagram including an example method of controlling sound output within a vehicle to attenuate sound produced by tires of a vehicle.

FIG. 3 includes a flowchart depicting an example method of cancelling or attenuating noise produced by tires within a passenger cabin of a vehicle. Control begins with 304 where the enabling/disabling module 220 determines whether all of the wheel speeds 172 are within the predetermined speed range. If 304 is false (i.e., if one or more of the wheel speeds 172 is outside of the predetermined speed range), the enabling/disabling module 220 disables the FT module 224 and the order module 228, and control continues with 308. At 308, the sound control module 204 sets the characteristics 208 to not cancel or attenuate tire noise. The sound control module 204 may, however, set the characteristics 208 to attenuate or cancel engine and/or driveline noise. If 304 is true, the enabling/disabling module 220 enables the FT module 224 and the order module 228, and control continues with 312.

At 312, the FT module 224 generates the acceleration spectrums 240 for each of the wheels. Each of the acceleration spectrums 240 includes amplitudes of acceleration at orders of the frequency corresponding to that one of the wheel speeds 172. At 316, the order module 228 determines whether at least one of the amplitudes (of acceleration) of one of the acceleration spectrums 240 for one of the wheels is greater than the predetermined value (i.e., predetermined acceleration). If 316 is true, control continues with 320. If 316 is false, control transfers to 308 where the sound control module 204 sets the characteristics 208 to not cancel or attenuate tire noise.

At 320, the order module 228 determines the wheel orders 236 for each of the wheels at which to generate the predetermined tones 248 to cancel or attenuate tire noise. The order module 228 generates the wheel orders 236 based on the amplitude that is greater than the predetermined value. For the one of the wheels that is associated with the one of the amplitudes (of acceleration) of one of the acceleration spectrums 240 that is greater than the predetermined value, the order module 228 may set the order based on the amplitude divided by the one of the wheel speeds 172 of that wheel. The order module 228 sets the ones of the orders 236 for the other wheels, respectively, based on the one of the amplitudes and the ones of the wheel speeds 172 of the other wheels, respectively. For example, for one of the other wheels, the order module 228 sets the one of the wheel orders 236 based on the one of the amplitudes divided by the one of the wheel speeds 172 of that one of the other wheels.

At 324, the sound control module 204 sets the characteristics 208 for outputting the one of the predetermined tones 248 for tire noise cancellation or attenuation. More specifically, the sound control module 204 determines the frequencies at which to output the one of the predetermined tones 248. The sound control module 204 determines the frequencies based on the wheel orders 236 and the wheel speeds 172, respectively. For example, for the left front tire, the sound control module 204 determines the frequency for the left front tire based on the one of the wheel orders 236 (for the left front tire) and the one of the wheel speeds 172 of the left front tire.

The sound control module 204 also sets the magnitudes for outputting the one of the predetermined tones 248 at 324. The sound control module 204 may set the magnitudes to the predetermined magnitude, based on the one of the amplitudes, and/or based on the microphone signal 244.

At 328, the audio driver module 260 applies power to ones of the speakers 184 based on the frequencies determined for the wheels, respectively. Generally speaking, the audio driver module 260 may apply power to ones of the speakers 184 on the opposite side (left or right) of the vehicle as the associated tire. For example, for the frequency and magnitude for outputting the one of the predetermined tones 248 for the left front tire, the audio driver module 260 applies power to one or more of the speakers 184 associated with the right front tire at the frequency and the magnitude. As another example, for the frequency and magnitude for outputting the one of the predetermined tones 248 for the right rear tire, the audio driver module 260 applies power to one or more of the speakers 184 associated with the left rear tire at the frequency and the magnitude.

Alternatively, the audio driver module 260 may apply power to ones of the speakers 184 on the same side (left or right) of the vehicle as the associated tire. For example, for the frequency and magnitude for outputting the one of the predetermined tones 248 for the left front tire, the audio driver module 260 applies power to one or more of the speakers 184 associated with the left front tire at the frequency and the magnitude. As another example, for the frequency and magnitude for outputting the one of the predetermined tones 248 for the right rear tire, the audio driver module 260 applies power to one or more of the speakers 184 associated with the right rear tire at the frequency and the magnitude.

The speakers 184 within the passenger cabin produce sound in response to the application of power, and the sound attenuates noise within the passenger cabin that is attributable to the tires. While the example of FIG. 3 ending is shown, the example of FIG. 3 is illustrative of one control loop and control may return to 304.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Peri, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

None of the elements recited in the claims are intended to be a means-plus-function element within the meaning of 35 U.S.C. § 112(f) unless an element is expressly recited using the phrase "means for," or in the case of a method claim using the phrases "operation for" or "step for."

What is claimed is:

1. An audio control system for mitigating structural noise from tires of a vehicle, comprising:

a Fourier Transform (FT) module configured to determine amplitudes of acceleration at predetermined orders, respectively, by performing a FT on a plurality of values of acceleration associated with a first wheel of the vehicle;

an order module configured to identify one of the predetermined orders where one of the amplitudes is greater than a predetermined value and to, based on the one of the amplitudes and a first rotational speed of the first wheel, determine a first order of a first frequency corresponding to the first rotational speed of the first wheel of the vehicle;

a sound control module configured to set characteristics for outputting sound at the first order of the first frequency corresponding to the first rotational speed of the first wheel; and an audio driver module configured to, based on the characteristics, apply power to a first speaker within a passenger cabin of the vehicle at the first order of the first frequency corresponding to the first rotational speed of the first wheel.

2. The audio control system of claim 1 wherein the order module is configured to determine the first order of the first frequency corresponding to the first rotational speed of the first wheel based on the one of the amplitudes divided by the first rotational speed of the first wheel.

3. The audio control system of claim 2 wherein:

the order module is further configured to determine a second order of a second frequency corresponding to a second rotational speed of a second wheel based on the one of the amplitudes and the second rotational speed of the second wheel;

the sound control module is further configured to set the characteristics for outputting sound at the second order of the second frequency corresponding to the second rotational speed of a second wheel; and the audio driver module is further configured to, based on the characteristics, apply power to a second speaker within the passenger cabin of the vehicle at the second order of the second frequency.

4. The audio control system of claim 3 wherein:

the order module is further configured to determine a third order of a third frequency corresponding to a third rotational speed of a third wheel based on the one of the amplitudes and the third rotational speed of the third wheel;

the sound control module is further configured to set the characteristics for outputting sound at the third order of the third frequency corresponding to the third rotational speed of the third wheel; and the audio driver module is further configured to, based on the characteristics, apply power to a third speaker within the passenger cabin of the vehicle at the third order of the third frequency.

5. The audio control system of claim 4 wherein:

the order module is further configured to determine a fourth order of a fourth frequency corresponding to a fourth rotational speed of a fourth wheel based on the one of the amplitudes and the fourth rotational speed of the fourth wheel;

the sound control module is further configured to set the characteristics for outputting sound at the fourth order of the fourth frequency corresponding to the fourth rotational speed of the fourth wheel; and the audio driver module is further configured to, based on the characteristics, apply power to a fourth speaker of the vehicle at the fourth order of the fourth frequency.

6. The audio control system of claim 1 further comprising an enabling/disabling module configured to disable the FT module and the order module when at least one of:

the first rotational speed of the first wheel is less than a first predetermined speed; and the first rotational speed of the first wheel is greater than a second predetermined speed, wherein the second predetermined speed is greater than the first predetermined speed.

7. The audio control system of claim 6 wherein the first predetermined speed is greater than zero.

8. The audio control system of claim 1 further comprising an enabling/disabling module configured to disable the FT module and the order module when at least one of:

the first rotational speed of the first wheel is less than a first predetermined speed;

the first rotational speed of the first wheel is greater than a second predetermined speed, wherein the second predetermined speed is greater than the first predetermined speed;

a second rotational speed of a second wheel is less than the first predetermined speed;

the second rotational speed of the second wheel is greater than the second predetermined speed;

a third rotational speed of a third wheel is less than the first predetermined speed;

the third rotational speed of the third wheel is greater than the second predetermined speed;

a fourth rotational speed of a fourth wheel is less than the first predetermined speed; and the fourth rotational speed of the fourth wheel is greater than the second predetermined speed.

9. The audio control system of claim 8 wherein the enabling/disabling module is configured to enable the FT module and the order module when all of:

the first rotational speed of the first wheel is greater than the first predetermined speed and less than the second predetermined speed;

the second rotational speed of the second wheel is greater than the first predetermined speed and less than the second predetermined speed;

the third rotational speed of the third wheel is greater than the first predetermined speed and less than the second predetermined speed; and the fourth rotational speed of the fourth wheel is greater than the first predetermined speed and less than the second predetermined speed.

10. The audio control system of claim 1 wherein:

the first speaker is located on one of a left side of the vehicle and a right side of the vehicle; and the first wheel is located on the other one of the left side of the vehicle and the right side of the vehicle.

11. The audio control system of claim 1 wherein the first speaker is associated with the first wheel of the vehicle.

12. The audio control system of claim 1 wherein the acceleration is measured using an acceleration sensor associated with the first wheel of the vehicle.

13. The audio control system of claim 1 wherein the FT is one of a Fast Fourier Transform (FFT) and a Discrete Fourier Transform (DFT).

14. The audio control system of claim 1 further comprising a first wheel speed sensor is configured to measure the first rotational speed of the first wheel.

15. The audio control system of claim 1 further comprising an acceleration sensor that is associated with the first wheel and that is configured to measure the plurality of values of the acceleration associated with the first wheel.

16. The audio control system of claim 1 wherein the sound control module is configured to set a magnitude for outputting sound at the first order of the first frequency corresponding to the first rotational speed of the first wheel based on the one of the amplitudes, and wherein the audio driver module is configured to, at the first order of the first frequency corresponding to the first rotational speed of the first wheel, apply power to the first speaker based on the magnitude.

17. The audio control system of claim 1 wherein the sound control module configured to set a magnitude for outputting sound at the first orders of the first frequency corresponding to the first rotational speed of the first wheel based on sound within the passenger cabin received by a microphone within the passenger cabin of the vehicle, and wherein the audio driver module is configured to, at the first order of the first frequency corresponding to the first rotational speed of the first wheel, apply power to the first speaker based on the magnitude.

18. The audio control system of claim 1 wherein the sound control module configured to set a magnitude for outputting sound at the first order of the first frequency corresponding to the first rotational speed of the first wheel to a predetermined magnitude, and wherein the audio driver module is configured to, at the first order of the first frequency corresponding to the first rotational speed of the first wheel, apply power to the first speaker based on the magnitude.

19. An audio control method for mitigating structural noise from tires of a vehicle, comprising:

determining amplitudes of acceleration at predetermined orders, respectively, by performing a Fourier Transform (FT) on a plurality of values of acceleration associated with a first wheel of the vehicle;

identifying one of the predetermined orders where one of the amplitudes is greater than a predetermined value;

based on the one of the amplitudes and a first rotational speed of the first wheel, determining a first order of a first frequency corresponding to the first rotational speed of the first wheel of the vehicle;

setting characteristics for outputting sound at the first order of the first frequency corresponding to the first rotational speed of the first wheel; and based on the characteristics, applying power to a first speaker within a passenger cabin of the vehicle at the first order of the first frequency corresponding to the first rotational speed of the first wheel.

20. A non-transitory computer readable medium comprising instructions that, when executed, perform a method for mitigating structural noise from tires of a vehicle comprising:

determining amplitudes of acceleration at predetermined orders, respectively, by performing a Fourier Transform (FT) on a plurality of values of acceleration associated with a first wheel of the vehicle;

identifying one of the predetermined orders where one of the amplitudes is greater than a predetermined value;

based on the one of the amplitudes and a first rotational speed of the first wheel, determining a first order of a first frequency corresponding to the first rotational speed of the first wheel of the vehicle;

setting characteristics for outputting sound at the first order of the first frequency corresponding to the first rotational speed of the first wheel; and based on the characteristics, applying power to a first speaker within a passenger cabin of the vehicle at the first order of the first frequency corresponding to the first rotational speed of the first wheel.

* * * * *